US006273386B1

(12) United States Patent
Boeder

(10) Patent No.: US 6,273,386 B1
(45) Date of Patent: Aug. 14, 2001

(54) EYEGLASSES HOLDER

(76) Inventor: Ronald S. Boeder, 1039 Serpentine La. Suite E, Pleasanton, CA (US) 94566

( * ) Notice: Subject to any disclaimer, the term of this patent is extended or adjusted under 35 U.S.C. 154(b) by 0 days.

(21) Appl. No.: 09/417,905

(22) Filed: Oct. 14, 1999

Related U.S. Application Data

(60) Provisional application No. 60/104,622, filed on Oct. 14, 1998.

(51) Int. Cl.[7] ..... A47F 5/00
(52) U.S. Cl. ..... 248/309.1; 248/902
(58) Field of Search ..... 248/309.1, 902, 248/27.8; 211/205, 185

(56) References Cited

U.S. PATENT DOCUMENTS 4,150,752 * 4/1979 Breining et al. ..... 248/902 X
5,137,242 * 8/1992 Reath ..... 248/309.1
5,265,736 11/1993 Orr .
5,921,409 7/1999 Gerber et al. .
6,102,346 * 8/2000 Visser ..... 248/902 X

* cited by examiner

*Primary Examiner*—Ramon O. Ramirez
(74) *Attorney, Agent, or Firm*—Carol D. Titus; James J. Leary

(57) ABSTRACT

A freestanding holder for eyeglasses or sunglasses having one or more slots cut in the exterior surface of any geometric shape. The slots are sized to receive the earpieces of a pair of eyeglasses. In one embodiment, the holder is formed of a base and a central post. The slot is formed between the base and post. The angled or curved slots mimic the angle of the partially folded glasses. When the user places the earpieces within the slots, the eyeglasses are held upright or in a cantilevered manner.

26 Claims, 7 Drawing Sheets

EYEGLASSES HOLDER

CROSS REFERENCE TO OTHER APPLICATIONS

This application claims the benefit of U.S. Provisional Patent Application No. 60/104,622 filed Oct. 14, 1998.

FIELD OF INVENTION

The present invention relates generally to devices for holding eyeglasses and sunglasses. More particularly it relates to a free standing display device for holding and/or displaying a pair of eyeglasses.

BACKGROUND OF THE INVENTION

U.S. Pat. No. 5,921,409 to Gerber et al. discloses a V-shaped eye wear display device including two temple free end receiving cavities which support the eyeglasses frames by the temple free ends. However, Gerber et al. is limited in the size of temple free ends, earpieces, it can accommodate. It is also limited to a single angle and orientation of display.

U.S. Pat. No. 5,265,736 to Orr discloses an apparatus for displaying eyeglasses frames including an elongate square channel-shaped base member that indudes a flat bottom wall, a rear wall and a front wall The rear and front walls are parallel to one another and accommodate therebetween the free ends of the temple pieces of a plurality of eyeglasses frames that are positioned along the extent of the base member. The front wall has a greater height than the rear wall so that the temple pieces are maintained in a horizontal plane when the rear wall of the base member is secured to a vertical support surface. The spacing between the rear wall and the front wall is predetermined in accordance with the respective heights of the front and rear walls to prevent the free ends of the temple pieces from falling out.

SUMMARY OF THE INVENTION

The present invention provides a quick and easy place to attractively store and/or display any pair of eyeglasses for home, office or retail purposes. The eyeglasses are held in a semi-open position, thereby reducing the rate at which the temple screws loosen by reducing the amount of folding and unfolding of the eyeglasses. The eyeglasses are held off of the tabletop, thereby reducing the chances of the eyeglasses becoming accidentally damaged and, at the same time, reducing the amount of space necessary to hold the eyeglasses. Furthermore, when placed upon a desktop, the holder places the eyeglasses such that a user is less likely to forget to take the eyeglasses when leaving.

In keeping with the foregoing discussion, the present invention takes the form of a free standing holder for eyeglasses or sunglasses. The exterior of the holder may form any geometric or freeform shape having sufficient size and weight to hold a cantilevered pair of glasses without falling over. In one embodiment, the holder is a half-sphere with the flat side as the base. A groove or slot is cut about two-thirds up the side and is revolved around the sphere to form a full circle. The slot is sized and configured to hold the earpieces of a pair of eyeglasses. The slot shown enters the sphere at approximately 30-degree angle and is approximately 0.25 inches wide and 1.00 inch deep.

Alternate embodiments have two or more slots which only revolve part way around the unit or have one or more slots which are not on the same vertical plane, thereby holding the eyeglasses with the ear pieces at different angles causing the eyeglasses to rest at a canted angle. The holder may also have two straight slots, at an angle to each other, cut in the top of the holder. In the top view the slots are angled toward each other to mimic the angle of the partially folded eyeglasses. The mimicking of the eyeglasses earpieces is also achieved by the continuous round slot.

The holder may be formed of a single piece or it may be formed by two or more pieces. For example, a central post may fit within a base having an opening extending therethrough. Along the exterior surface, there is a gap between the post and the base. The gap forms a slot configured to hold the earpieces of the pair of eyeglasses. Other objects and advantages of the invention will no doubt occur to those skilled in the art upon reading and understanding the following detailed description along with the accompanying drawings.

DETAILED DESCRIPTION OF THE INVENTION

The present invention is a device for holding, storing and/or displaying eyeglasses or sunglasses when not being worn. The holder is primarily intended for use on a tabletop, desktop or display shelf. However, it not limited to these locations. It can also be used in an automobile or other locations. The holder may be used for short-term storage, and may also be used for extended storage or retail display.

Figure 1A:
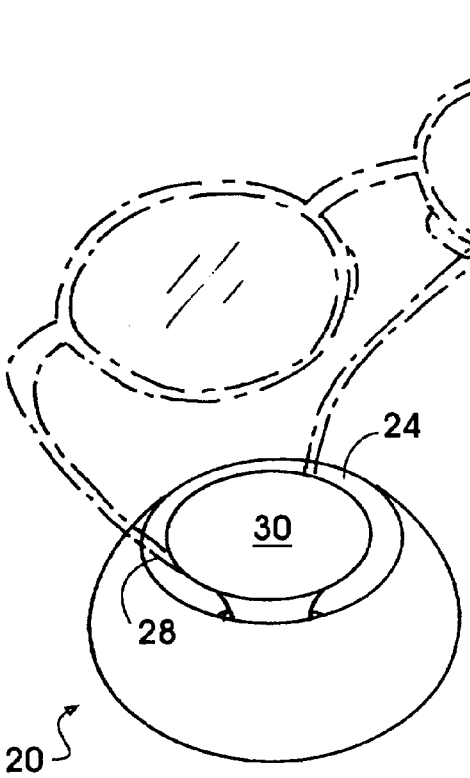
FIG. 1A is a top perspective view of the eyeglasses holder holding a pair of eyeglasses.
Figure 1B:
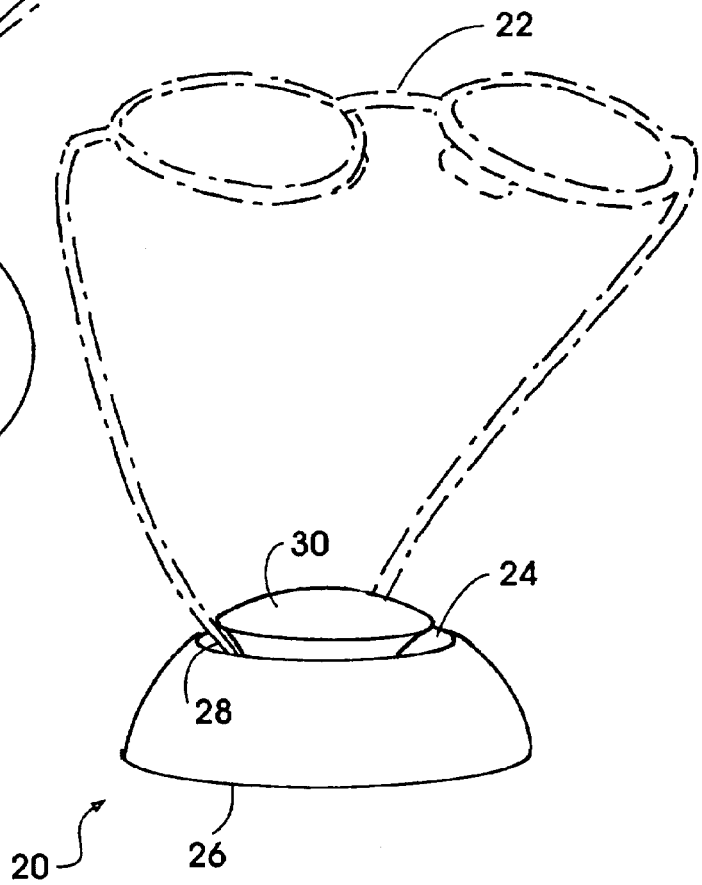
FIG. 1B is a side view of the eyeglasses holder holding a pair of eyeglasses.
Figure 3A:
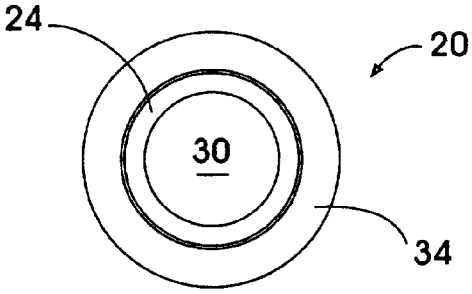
FIGS. 3A and 3B are top and side views of a semi-spherical eyeglasses holder having a single, circular slot.
Figure 3B:
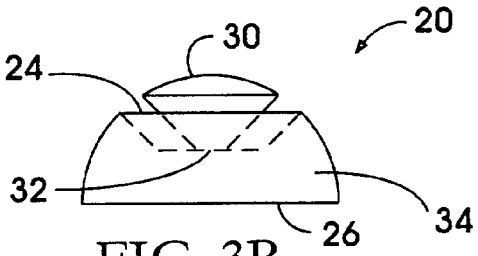

FIG. 1A is a top perspective view of a semi-spherical eyeglasses holder 20 holding a pair of eyeglasses 22 and FIG. 1B is a side view. FIGS. 3A and 3B are top and side views of the holder 20. The embodiment shown of the eyeglasses holder 20 is generally hemispherical with the flat side as the bottom surface 26. One or more grooves or slots 24 are cut in the upper, curved surface of the holder 20. In the embodiment shown, a single slot 24 is used. The curved slot 24 naturally mimics the angle of the eyeglasses earpieces 28 for easy insertion. The slot 24 is located partway up the exterior surface of the holder 20. The slot 24 may be located at a height of anywhere from about 25% of the height to about 90% of the height, more preferably between 40% and 80% of the height, most preferably between 50% and 75% of the height. In the embodiment shown, the slot enters the holder 20 at about 66% of the height of the holder 20 and is revolved around the hemisphere to form a full circle to accommodate the eyeglasses ear pieces 28. The slot 24 enters the sphere at an angle. Although any angle may be used, an angle within the range of 15 to 85 from vertical degrees is preferred, more preferably in the range of 20 to 50 degrees and most preferably in the range of 25–35 degrees. The embodiment shown has a slot 24 entering at approximately 30 degrees. The slot 24 may be of varying shapes and orientations. For standard eyeglasses 22, the slot 24 preferably has a width of 0.15 to 0.50 inches, more preferably between 0.20 and 0.40 inches, most preferably between 0.20 and 0.30 inches. The slot shown is approximately 0.25 inches wide. For standard eyeglasses 22, the slot 24 preferably has a depth of 0.25 to 2.0 inches, more preferably between 0.50 and 1.5 inches and most preferably between 0.75 inches and 1.25 inches. The slot 24 show is approximately 1.00 inch deep.

Figure 2A:
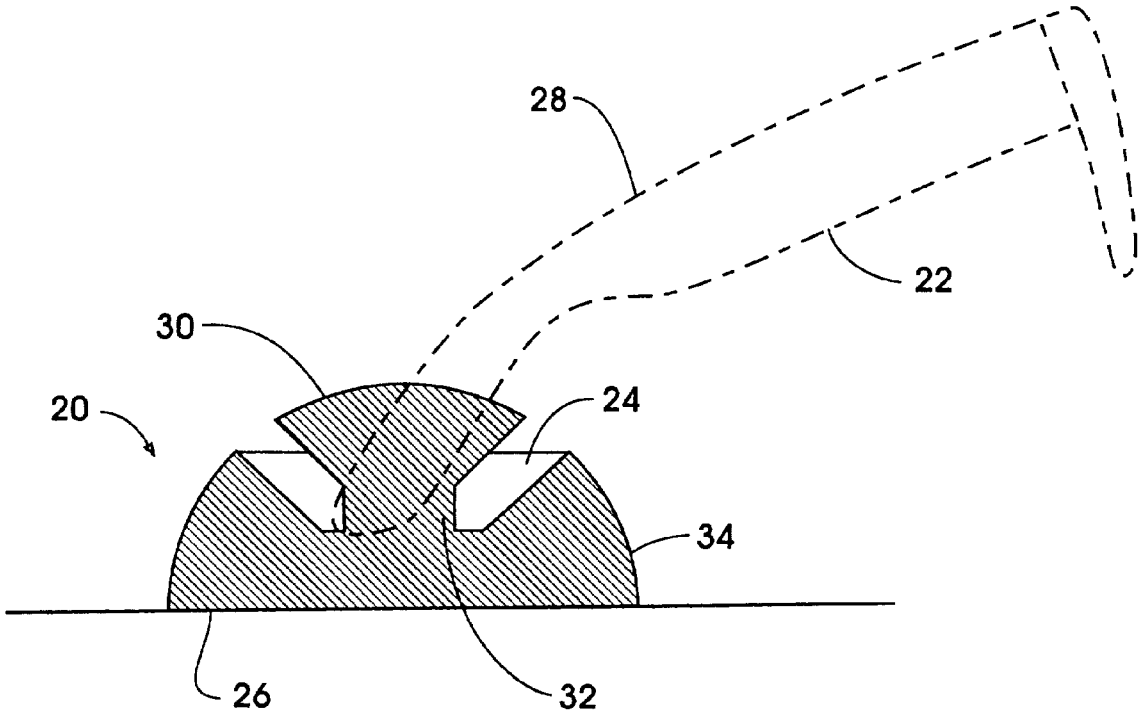
FIG. 2A is a side, cross-sectional view of the eyeglasses holder holding a pair of eyeglasses with large earpieces.
Figure 2B:
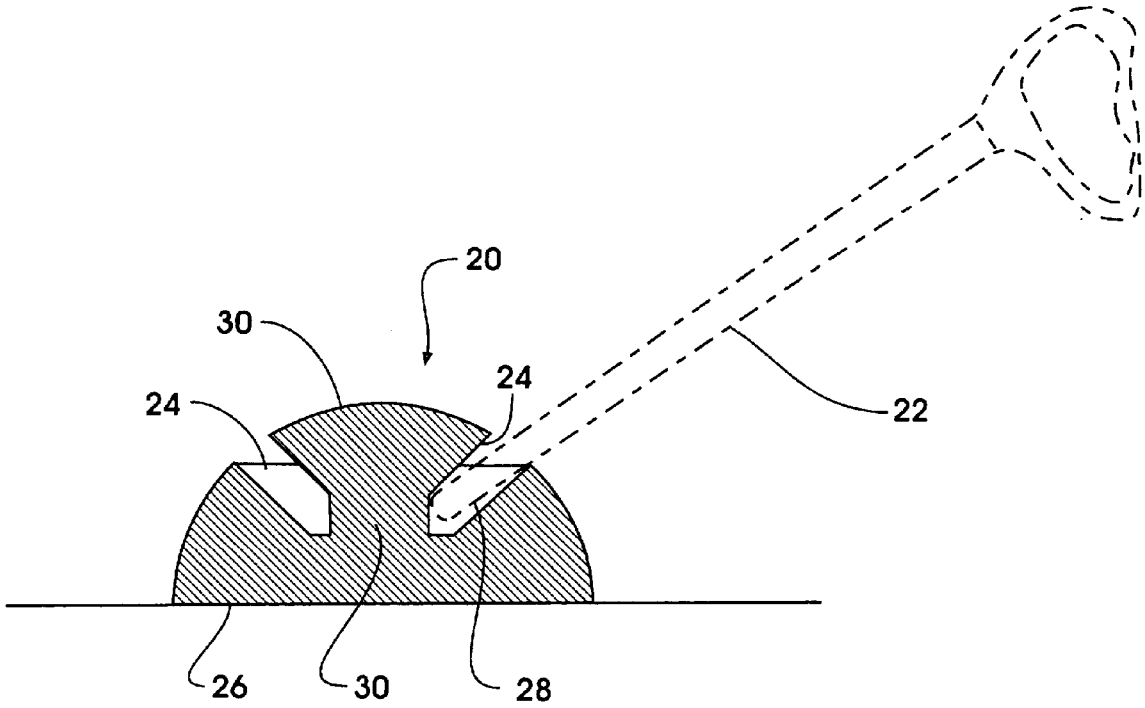
FIG. 2B is a side, cross-sectional view of the eyeglasses holder holding a pair of eyeglasses with straight earpieces.
Figure 2C:
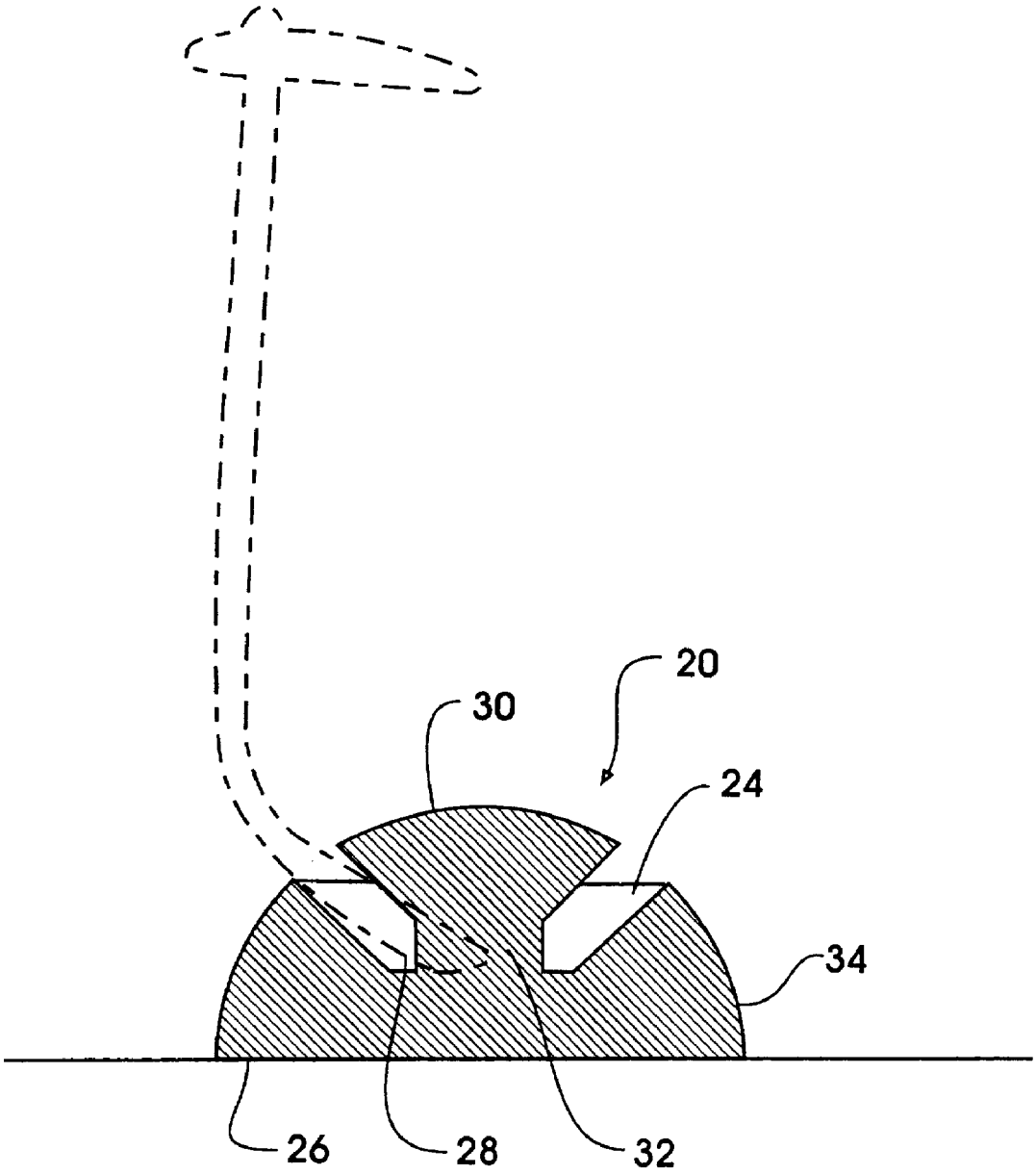
FIG. 2C is a side, cross-sectional view of the eyeglasses holder holding a pair of eyeglasses with curved earpieces.

FIGS. 2A–2C are side, cross-sectional views of the eyeglasses holder 20 holding pairs of eyeglasses 22 with different styles of earpieces 28. The holder 20 will work with all or nearly all eyeglasses 22 including eyeglasses 22 with very large ear pieces 28 (FIG. 2A), very small ear pieces 28, curved ear pieces 28 (FIG. 2C) or straight ear pieces 28 (FIG. 2B). Depending on the geometry of the earpieces 28, the eyeglasses 22 will be held in at an angle between horizontal and vertical. A pair of eyeglasses 22 with straight ear pieces 28 will be held at an angle to the tabletop that slightly less than the angle at which the slot 24 enters the holder 20. A pair of eyeglasses 22 with very curved ear pieces 28 will be held closer to vertical and be nearly perpendicular to the tabletop. Some adjustment to the angle may also be made by adjusting the angle and location of the earpieces 28 within the slot 24. For example, a user may manually adjust the angle at which the eyeglasses 28 rest by rotating the earpieces 28 within the slot 24. Friction between the holder 20 and the earpieces 28 will hold most eyeglasses 28 at any angle from horizontal to vertical. Without adjustment, most eyeglasses 22 will rest at a dynamic and interesting ergonomic angle of approximately 45 degrees.

Figure 4A:
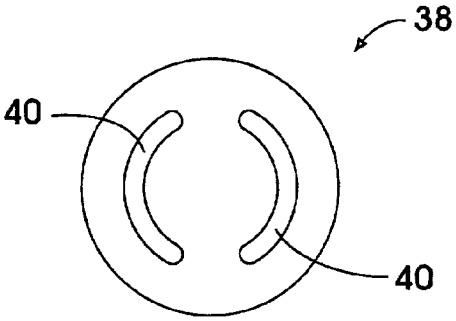
FIGS. 4A and 4B are top and side views of a semi-spherical eyeglasses holder having a pair of slots.
Figure 4B:
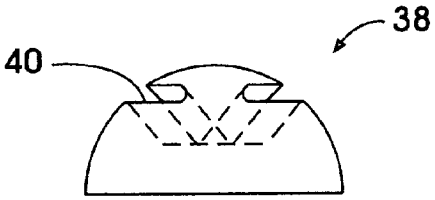

FIGS. 4A–14 show the eyeglasses holder in a multiplicity of different shapes and configurations. The eyeglasses holder may be formed of any geometric solid, of sufficient size and weight to hold a cantilevered pair of eyeglasses 22 without falling over. For example, FIGS. 4A and 4B are top and side views of a hemispherical eyeglasses holder 38 having a pair of slots 40. The slots 40 in this embodiment have generally the same angle, depth and width as the previous embodiment, but only extend part of the way around the holder 38. These slots 40 form two arcs located on opposite sides of the holder 38. The design could also be made with a larger number of slots 40 forming arcs extending part or all the way around the holder 38. Alternately, the holder 38 may have slots that are straight or zigzagged or form other decorative designs.

Figure 5A:
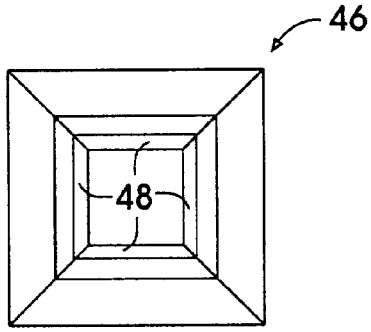
FIGS. 5A and 5B are top and side views of an eyeglasses holder in the shape of a frustum of a pyramid.
Figure 5B:
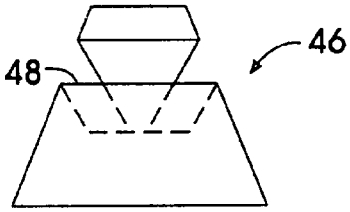

FIGS. 5A and 5B are top and side views of an eyeglasses holder 46 in the shape of a frustum of a pyramid. In this embodiment, the holder 46 may be formed from two pieces or from the single piece as shown. The angle of the walls and/or overall height of the holder 46 may be varied. The slot 48 shown forms a full square. If preferred, the holder 46 may be formed with two slots on opposite or adjacent edges extending part or the full width of a particular level of the frustum.

Figure 6A:
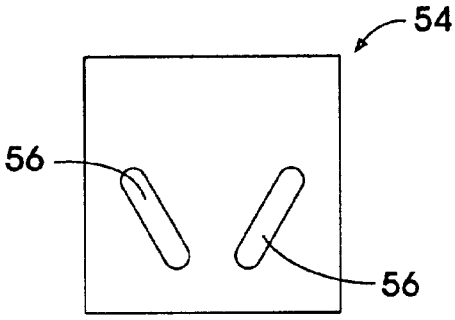
FIGS. 6A and 6B are top and side views of a rectangular eyeglasses holder.
Figure 6B:
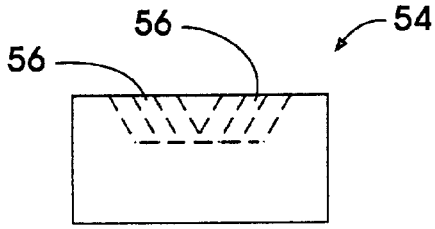

FIGS. 6A and 6B are top and side views of a rectangular eyeglasses holder 54. In this embodiment, the holder 54 has a square plan view and a rectangular side view. Alternately, the holder 54 could form a cube or be rectangular in both views. The holder 54 shown as two slots 56 at an angle to one another. The angled slots 56 naturally mimic the angle of the eyeglasses earpieces 28 for easy insertion. Although other angles may be chosen, the angle between the slots 56 is preferably in the range of 5 to 135 degrees, more preferably between 30 and 90 degrees, most preferably between 45 and 75 degrees. In the embodiment shown, the slots 56 are angled at approximately 60 degrees.

Figure 7:
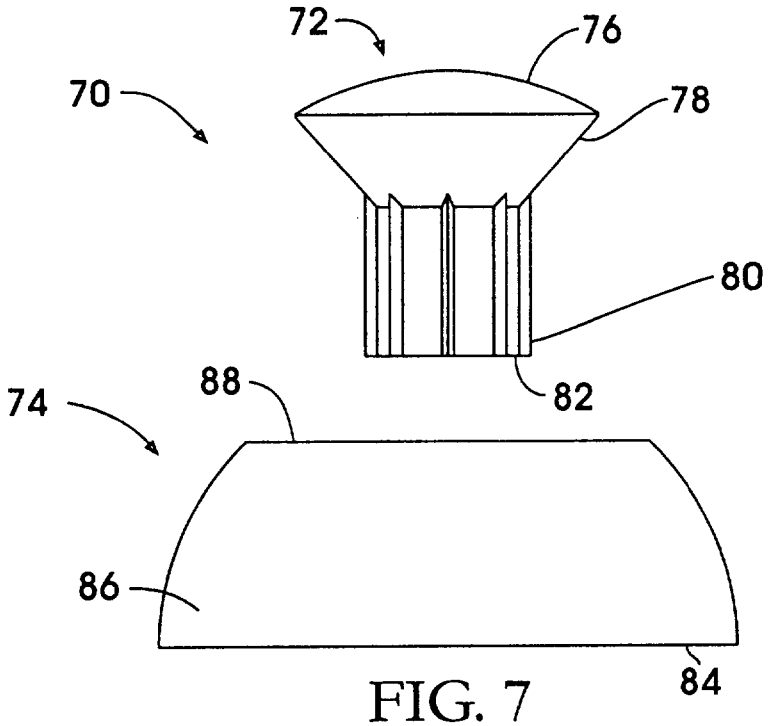
FIG. 7 is an exploded view of a two-piece, semi-spherical eyeglasses holder.
Figure 8:
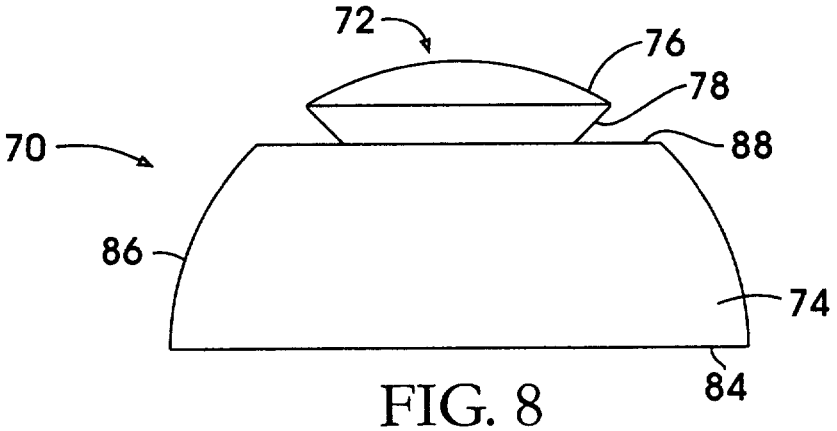
FIG. 8 is a side view of semi-spherical eyeglasses holder.
Figure 9:
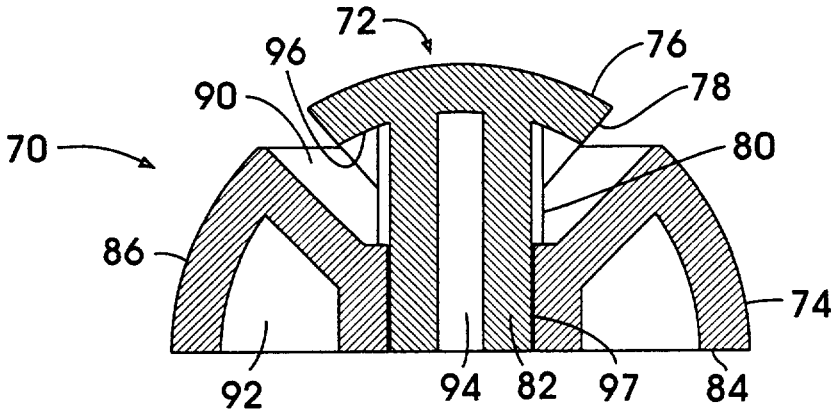
FIG. 9 is a cross-sectional view of a thin-walled, semi-spherical eyeglasses holder.

FIG. 7 is an exploded view of a two-piece, semi-spherical eyeglasses holder 70; FIG. 8 is a side view and FIG. 9 a cross-section of the two-piece embodiments with an alternate central post 72. The holder 70 may be formed from two pieces: a central post 72 and a base 74 forming a ring into which the central post 72 may be placed. The outer diameter of the central post 72 is sized to fit snugly within the interior opening 88 of the base 74. Alternately, a projection or other means may be used to hold the post 72 in the proper configuration. The two piece versions of the present invention may be used to create an adjustable eyeglasses holder if the user chooses to change the width of the slot 98 by moving the central post 72 up or down. Adjusting the width of the slot 98 will change the angle at which the eyeglasses 22 are held. The top surface 76 of the central post 72 is the shape of a chordal section of a sphere having generally the same diameter as the partial sphere-shape of the base. The lower portion of the central post 72 is generally cylindrical portion 82 with a plurality of ridges 80 extending vertically along the length of the cylindrical portion 82. In FIG. 7, the central post 72 is shown having a frustum of a cone 72 which extends the full distance between the top surface 76 of the central post 72 and the cylindrical portion 82. FIG. 9 shows an alternate version of the central post 72.

The modified central post having an undercut lip 96. The undercut surface is generally parallel to the top surface 76 of the post 72 and connects the cylindrical portion 82 and an edge of the conical portion. The undercut lip 96 improves the manufacturability of the design by creating a uniform wall thickness for improved injection molding, thereby reducing the costs and ease of molding and amount of material used.

Figure 10:
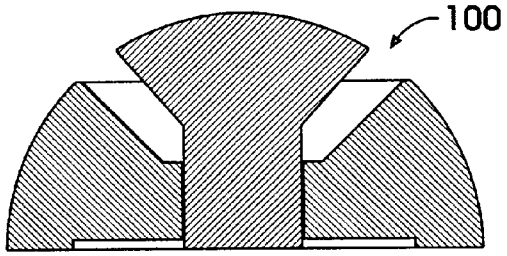
FIG. 10 is a cross-sectional view of solid eyeglasses holder.

FIG. 10 is a cross-sectional view of a solid eyeglasses holder 100. If the holder 100 is manufacture by machining or casting, the solid embodiment of the eyeglasses holder 100 is preferred. The solid embodiment has little or no extra depressions, thereby minimizing the necessary machining steps. A solid eyeglasses holder 100 may be ideal in situations where additional weight is desired, for example if the holder 100 also functions as a paperweight.

Figure 11:
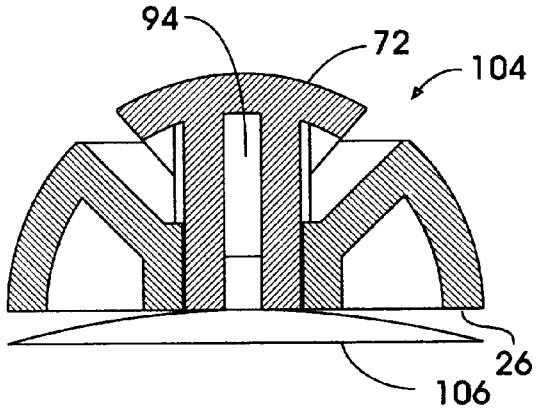
FIG. 11 is a cross-sectional view of an eyeglasses holder designed to mount with a suction cup.

FIG. 11 is a cross-sectional view of an eyeglasses holder 104 designed for mounting with a suction cup 106. If the holder 104 is to be mounted on a surface which is not horizontal, is unstable or moving, or if it is preferred that the holder have additional stability beyond that provided by the weight of the holder, a suction cup 106 may be added to the bottom surface 26 of the holder 106. The suction cup 106 may be friction fit, adhered or otherwise mechanically or chemically attached or bonded to the bottom 26 of the holder 104 or within an opening in the bottom surface 26.

Figure 12:
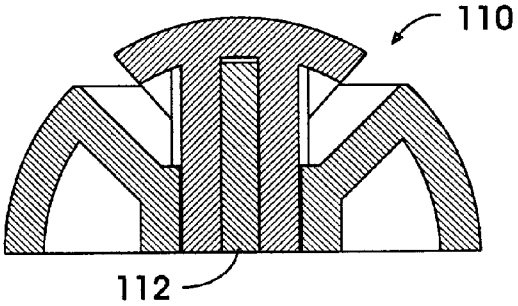
FIG. 12 is a cross-sectional view of an eyeglasses holder having an extra weight.

FIG. 12 is a cross-sectional view of an eyeglasses holder 110 with an extra weight 112. If the user wants additional weight for any reason, such as stability, a weight 112 may be added to the holder 110. For example, a plug 112 may be placed in the opening 94 in the central post 72 or one or more weights may be added around the perimeter of the base, within the circular opening 92 in the base 74 or any other convenient location.

Figure 13:
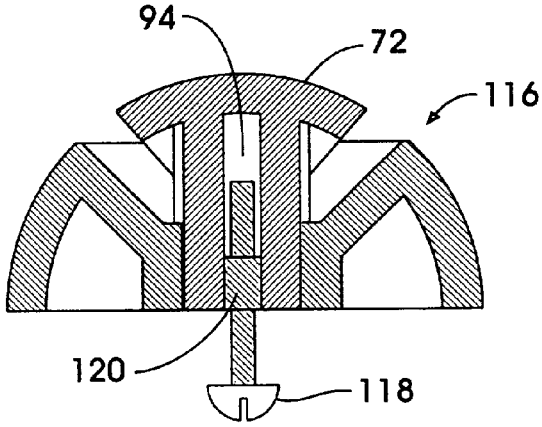
FIG. 13 is a cross-sectional view of an eyeglasses holder designed to mount with a screw.

FIG. 13 is a cross-sectional view of an eyeglasses holder 116 designed for mounting with a screw 118. If the holder 116 is to be attached more permanently or more securely, the user may use a screw 118 to mount the holder 116 to a surface. In the embodiment shown, a threaded insert 120 is placed into the opening 94 within the central post 72 into which a screw 118 may pass. Alternately, the interior surface of the opening 94 may be threaded or a threaded hole may be added elsewhere on the bottom surface of the holder 116.

Figure 14:
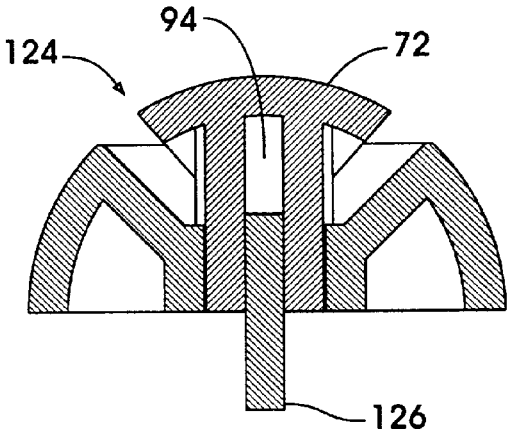
FIG. 14 is a cross-sectional view of an eyeglasses holder designed to mount with a pin.

FIG. 14 is a cross-sectional view of an eyeglasses holder 124 designed for mounting with a pin 126, thereby creating a less permanent attachment than the screw. The pin 126 may be friction fit, adhered or otherwise attached within the central opening 94 or other convenient location on the holder 124.

Most of the embodiments shown are omni-directional, so that a user may use or view the device from any angle. For the hemispherical embodiments, all of the side views of the device are the same.

Alternate embodiments may have two or more slots that only revolve part way around the unit or have one or more slots that are not on the same vertical plane, thereby holding the eyeglasses with the ear pieces at different angles.

The present invention may be cast, machined, fabricated, molded or formed by any other suitable technique from a variety of material including polymers, elastomers or ferrous. Other materials, such as other metals, wood, etc. are also acceptable. It is preferable to form the holder from rubber or other soft or resilient material to prevent damage to the eyeglasses' earpieces and tabletop. Alternately, a coating or insert may be used to modify the contact surfaces. It is also recommended that the unit have sufficient wall thickness to provide sufficient weight for stability. For simplicity of manufacture, the optimal design of the unit is made from two injection molded parts as shown in FIG. 9. However, it could also be made of a single solid part with a machined slot or from several parts to make the assembly.

OPERATIONAL DESCRIPTION

To place a pair of eyeglasses in the holder, the user folds his glasses partway.

For the preferred embodiments, the earpieces are approximately 2 inches apart. He then places the earpieces of his eyeglasses into the slot(s). When the user releases the eyeglasses, they are then held upright or in a cantilevered manner.

The glasses do not fall over because the earpiece rests against the leading edge of the slot, and the end of the earpiece rests against the lower rear side of the slot. Gravity pulls the heavy, cantilevered eyeglasses lenses downward, but they are held up by the angle and friction of the earpieces in the slot. Because of the downward angle of the slot and the angle on the earpieces, the earpieces naturally seat in the bottom of the slot.

Many features have been listed with particular configurations, options, and embodiments. Any one or more of the features described may be added to or combined with any of the other embodiments or other standard devices to create alternate combinations and embodiments.

Although the examples given include many specificities, they are intended as illustrative of only a few possible embodiments of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

I claim:

1. An eyeglasses holder for supporting a pair of eyeglasses, the holder comprising:

a base having a bottom surface and a upper surface, a central post extending at least partially from said upper surface of said base, a lower portion of said central post having a generally consistent cross section which is at least partially located within an opening passing through said base, and at least one elongated slot located between said upper surface of said base and said central post, said slot being at an angle such that at least a lower end of said central post is narrowed, said elongated slot sized and configured to retain an ear piece of the pair of eyeglasses.

2. The eyeglasses holder of claim 1 wherein the lower portion of said central post continuously narrows down to said lower end.

3. The eyeglasses holder of claim 2 wherein said lower end of said central post connects said central post to said base.

4. The eyeglasses holder of claim 1 wherein said slot has a width of approximately 0.25 inches.

5. The eyeglasses holder of claim 1 wherein said angle is between 20 and 50 degrees from vertical.

6. The eyeglasses holder of claim 1 wherein said angle is approximately 30 degrees from vertical.

7. The eyeglasses holder of claim 1 wherein said base and said central post are formed of separate pieces.

8. The eyeglasses holder of claim 7 wherein said central post and said base are friction fit together.

9. The eyeglasses holder of claim 1 wherein said slot has a width between 0.20 and 0.40 inches.

10. The eyeglasses holder of claim 1 wherein said at least one slot is a single slot forming a square.

11. An eyeglasses holder for supporting a pair of eyeglasses, the holder comprising:

a base having a bottom surface and a upper surface, said base forming at least a portion of a sphere, a central post extending at least partially from said upper surface of said base, and at least one elongated slot located between said upper surface of said base and said central post, said slot being at an angle such that at least a lower end of said central post is narrowed, said elongated slot sized and configured to retain an ear piece of the pair of eyeglasses.

12. The eyeglasses holder of claim 11 wherein the lower portion of said central post has a generally consistent cross section which is at least partially located within an opening passing through said base.

13. An eyeglasses holder for supporting a pair of eyeglasses, the holder comprising:

a base having a bottom surface and a upper surface, said base forming at least a portion of a pyramid, a central post extending at least partially from said upper surface of said base, and at least one elongated slot located between said upper surface of said base and said central post, said slot being at an angle such that at least a lower end of said central post is narrowed, said elongated slot sized and configured to retain an ear piece of the pair of eyeglasses.

14. An eyeglasses bolder for supporting a pair of eyeglasses, the holder comprising:

a base having a bottom surface and a upper surface, a central post extending at least partially from said upper surface of said base, and two, elongated, arc-shaped slots each forming at least a quarter of a circle, said slots located between said upper surface of said base and said central post, said slots being at an angle such that at least a lower end of said central post is narrowed, each of said elongated slots sized and configured to retain an ear piece of the pair of eyeglasses.

15. An eyeglasses holder for supporting a pair of eyeglasses, the holder comprising:

a base having a bottom surface and a upper surface, a central post extending at least partially from said upper surface of said base, and a single slot forming a circle located between said upper surface of said base and said central post, said slot being at an angle such that at least a lower end of said central post is narrowed, said elongated slot sized and configured to retain an ear piece of the pair of eyeglasses.

16. An eyeglasses holder for supporting a pair of eyeglasses, the holder comprising:

a base having a bottom surface and a upper surface, a central post extending at least partially from said upper surface of said base, and two linear slots located at an angle to one another, said slots located between said upper surface of said base and said central post, said slots being at an angle such that at least a lower end of said central post is narrowed, each of said elongated slots sized and configured to retain an ear piece of the pair of eyeglasses.

17. An eyeglasses holder for supporting a pair of eyeglasses, the holder comprising:

a base having an opening passing therethrough from a top surface to a bottom surface, a lower portion of said opening being generally cylindrical and having a first diameter, an upper portion of said opening being sloped outward and having a top edge having a second diameter, wherein said second diameter is larger than said first diameter, and a central post having a generally cylindrical lower portion and an upper portion forming a frustum of a cone, wherein said sloped upper portion of said base has generally the same angle as said frustum of said central post such that said cylindrical lower portion of said central post is positionable within said generally cylindrical opening in said base to form a generally circular slot having a generally consistent width located between said sloped upper surface and said frustum.

18. The eyeglasses holder of claim 17 further comprising at least one ridge located on said cylindrical lower portion of said central post and at least one groove located within said cylindrical opening within said base, said ridge sized and configured to fit within said groove.

19. The eyeglasses holder of claim 17 wherein a top surface of said central post is a chordal section of a sphere.

20. The eyeglasses holder of claim 19 wherein said central post has an undercut surface which is generally parallel to said top surface and intersects with said frustum of said central post and said cylindrical lower portion of said central post, thereby forming a lip.

21. The eyeglasses holder of claim 17 wherein said central post and said base are friction fit together.

22. The eyeglasses holder of claim 21 further comprising a insert having a threaded interior surface, said insert being attached within said opening in said central post.

23. The eyeglasses holder of claim 17 further comprising an opening extending into said central post from a lower end thereof.

24. The eyeglasses holder of claim 23 further comprising a suction cup attached within said opening in said central post.

25. The eyeglasses holder of claim 23 further comprising a weight located within said opening in said central post.

26. The eyeglasses holder of claim 23 further comprising a pin attached within said opening in said central post.

* * * * *